United States Patent [19]

Poole

[11] 4,085,670

[45] Apr. 25, 1978

[54] CHECK DIGIT NUMBERING MECHANISMS

[76] Inventor: William Poole, Paragon Works, Canning Town, London E. 16, England

[21] Appl. No.: 701,804

[22] Filed: Jul. 1, 1976

[30] Foreign Application Priority Data

Jul. 4, 1975 United Kingdom ..... 28198/75

[51] Int. Cl.[2] ..... B41U 3/42

[52] U.S. Cl. ..... 101/76; 101/77; 235/431; 340/146.1 AJ; 235/309; 101/93.12

[58] Field of Search ..... 101/72, 76, 77, 93.11, 101/93.12, 110; 235/61.7 A, 61.7 R, 153 AS; 340/146.1 AJ

[56] References Cited

U.S. PATENT DOCUMENTS

| | | | |
|---|---|---|---|
| 3,066,601 | 12/1962 | Eden | 235/153 AS |
| 3,603,251 | 9/1971 | Elsworth et al. | 101/76 |
| 3,650,205 | 3/1972 | Wybrow et al. | 101/72 |
| 3,740,531 | 6/1973 | Schinke et al. | 235/61.7 R |
| 3,772,989 | 11/1973 | Burkhardt et al. | 101/77 X |
| 3,815,495 | 6/1974 | Strackbein | 101/76 |
| 3,913,067 | 10/1975 | Goldberg | 340/146.1 AJ |

*Primary Examiner*—Edward M. Coven

*Attorney, Agent, or Firm*—Watson, Cole, Grindle & Watson

[57] ABSTRACT

A check digit numbering mechanism for generating check digits in accordance with a check digit load setting utilizes a check digit printing mechanism for printing a check digit on a printing medium including serial reference numerals. The check digit printing mechanism is indexed by a check digit numerator device. A plurality of solenoids and a corresponding plurality of movable armatures, each associated with a particular one of the solenoids, are provided such that at least one of the armatures is movable to engage the check digit numerator device to actuate it in association with the relative motion between the check digit numerator device and the solenoids. The plurality of solenoids are selectively actuated by a control mechanism which is responsive to a signal generated each time a reference number is printed on the printing medium to index the check digit numerator device to print an appropriate check digit associated with a given reference number on the printing medium. Switching circuitry changes the setting of the check digit numerator device to enable selected solenoids to receive appropriate signals in accordance with the check digit load setting.

10 Claims, 14 Drawing Figures

CHECK DIGIT NUMBERING MECHANISMS

This invention has reference to check digit numbering mechanism and has particular reference to check digit numbering mechanisms for use in a printing machine whereby not only is a serial reference number printed on each form length of a continuous stationery assembly or on each sheet of a series of sheets, for example in a book of cheques or series of postal orders but a check digit referring to that serial reference number is also printed.

Such mechanisms are required to include means to print a check digit number which is determined by a check digit code. For example, a check digit may be determined by starting with the number 0 corresponding to the serial number 0 of the serial number and at each unit printed this number may be decreased by a loading which consists, for example of a single digit. Thus, when the number 00001 is printed, the check digit will be 9 and when the number 00002 is printed the check digit will be 8 etcetera. When the number 00010 (10 being the modulus number) is reached, the next number printed substracts a number representative of tens. Thus, when the number 10 is reached the check digit number is decreased by a different number, that is to say, when the tens digit of a reference number is increased the check digit number is increased by a different unit digit, say 3, so that if a number 9 is printed it will bear the check digit 1, then the number 10 printed will bear the check digit of 7 (being decreased by one for the unit and two for the tens, making a total of three). Likewise, each time the tens number of the reference number is increased, the check digit number is decreased by three. In like manner, the reference number used when 100's of units are counted may represent a decrease in the check digit number by three. Thus, each time an extra 100 is printed, the check digit number is decreased by three.

Each digit is multiplied by the loading to determine the code number and all the digits of the code numbers (including the tens digits of such code numbers) are added together and divided by the modulus. The remainder can then constitute the check digit. Alternatively the check digit can be the complement of this remainder in that it constitutes the number which when added to the remainder gives the modulus.

It has also been proposed to print check digit numbers using a modified code in which the sum of the digits of the product numbers are used to determine the check digit rather than using the sum of the product numbers.

It is an object of the present invention to provide an improved check digit numbering mechanism which is capable of printing check digit numbers calculated by a number digit summation system.

It is a further object of the invention to provide a check digit numbering mechanism which can be readily used for printing check digits referred to different loadings and different modulii.

According to the present invention a check digit numbering mechanism comprises a printing means to print a reference number and a print wheel to print a check digit, print wheel actuating means to generate a pulse each time a serial reference number is printed, a plurality of solenoids to selected ones of which the pulses are passed, a control circuit to determine the number of pulses to be so passed and an armature associated with each one of the solenoids moveable into the path of the print wheel mechanism to move the print wheel whereby the check digit having reference to the several reference numbers is printed.

A check digit numbering mechanism in accordance with the invention will now be described by way of example with reference to the accompanying drawings wherein.

Figure 1:
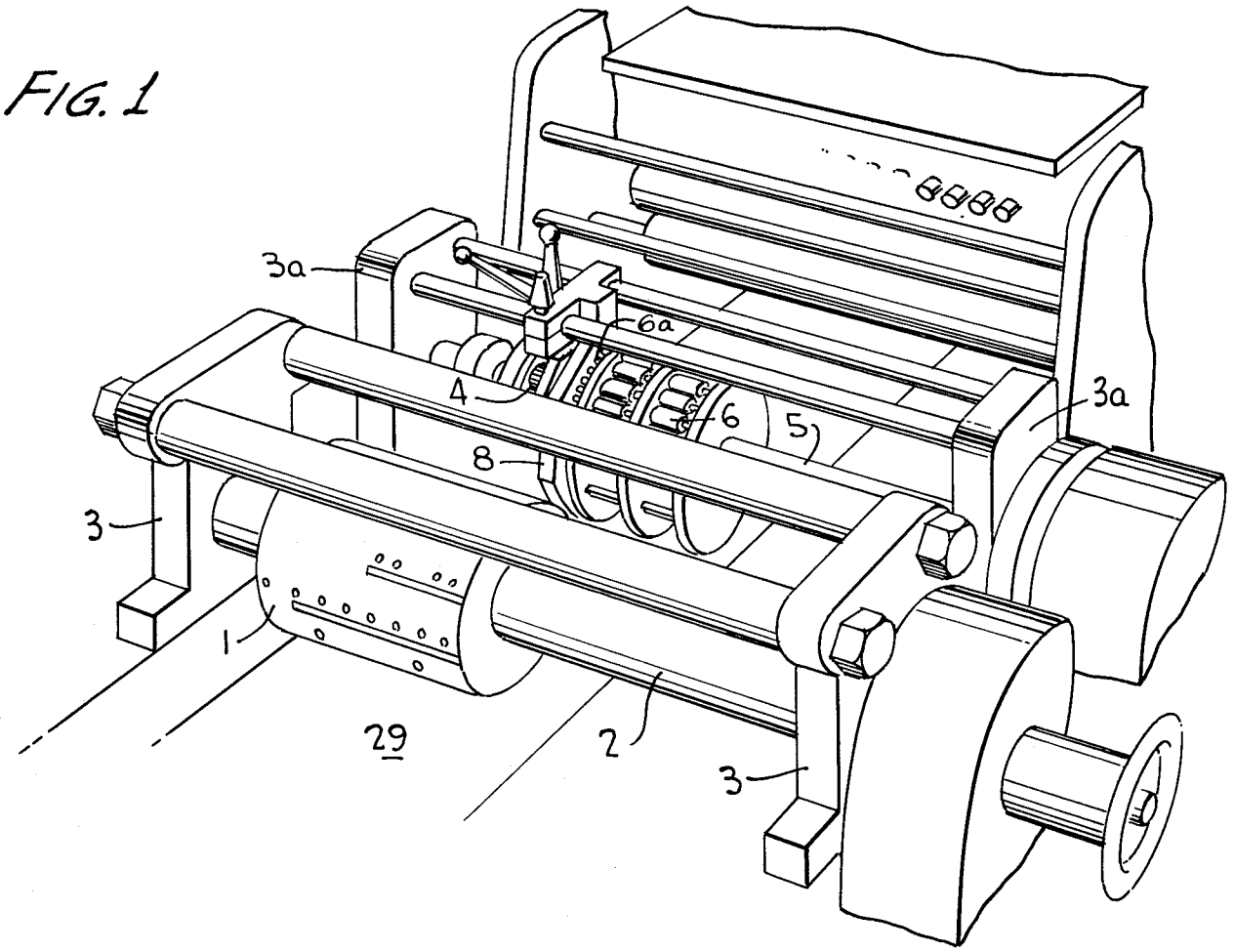
FIG. 1 is a perspective view of the check digit mechanism mounted on a printing machine

Referring to FIG. 1 of the drawings, there is shown a printing cylinder 1 which includes a numerator printing cylinder mechanism arranged to print a serial reference number on business forms.

In the embodiment of FIG. 1 this numerator printing cylinder mechanism is shown mounted on a collator mechanism. It will however be realised that the numerator printing cylinder mechanism may be mounted on other machines for example on a printing machine or it may be independent of any other mechanism or machine. This numerator printing mechanism is of the kind which applies a serial reference number to each form length of for example a continuous stationery web. A serial number is applied to one form length and the number applied to each respective succeeding form length is increased by one digit. If the continuous stationery is being numbered three round three serial number printing devices will be positioned around the printing cylinder and the reference number being printed will be indexed by three digits at each revolution of the printing cylinder. The printing cylinder mechanism includes a switch shown at 12 in FIG. 4 which is closed at each printing operation. Thus if the printing cylinder prints three round the switch is closed three times during each revolution of the printing cylinder.

The printing cylinder mechanism 1 is mounted on a cross shaft 2 mounted between side plates 3 and a check digit numerator mechanism 4 is mounted on a shaft 5 parallel to the shaft 2. The shaft 5 is likewise mounted between side plates 3*a*. The check digit numerator mechanism includes a plurality of sets of solenoids 6 fixedly mounted between the side plates 3. These solenoids are disposed in three sets of seven solenoids fitted three around. Other numbers of solenoids may be included. Thus, for example, if the check digit mechanism is fitted to a mechanism which is processing continuous stationery printed on a 24 inch circumference printing cylinder to produce 8 inch deep forms, there will be one set of seven solenoids for each 8 inch deep form. The solenoids of each set are arranged in two banks, the individual solenoids of one bank being off-set from and located behind the individual solenoids of the other bank. The armatures of these solenoids project out of the supporting disc 8 of the solenoids supporting mechanism with the solenoids of the rear bank having their armatures spaced between the individual solenoids in the front bank. These armatures in the operative condition of the solenoids project into a circumferential path of the indexing mechanism. The check digit numerator mechanism 4 is concentrically mounted with respect to the solenoid supporting mechanism and is rotatable with respect to these solenoids.

Figure 2:
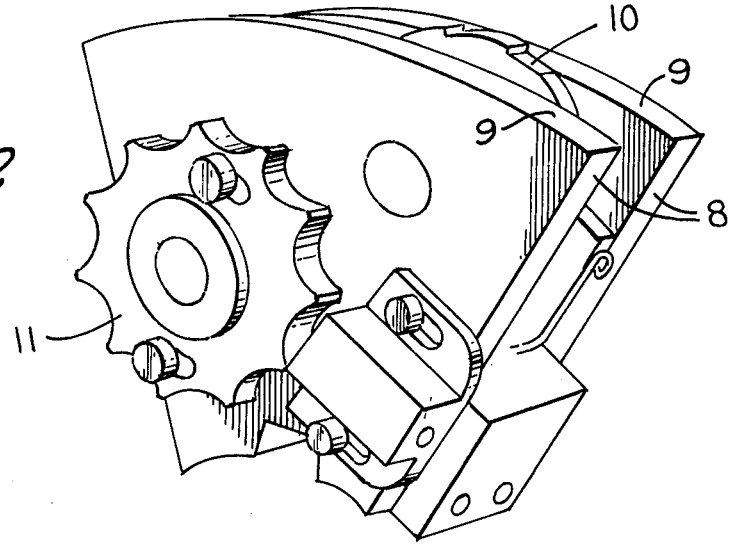
FIG. 2 is a detailed view of the indexing mechanism of the check digit numerator mechanism.
Figure 3:
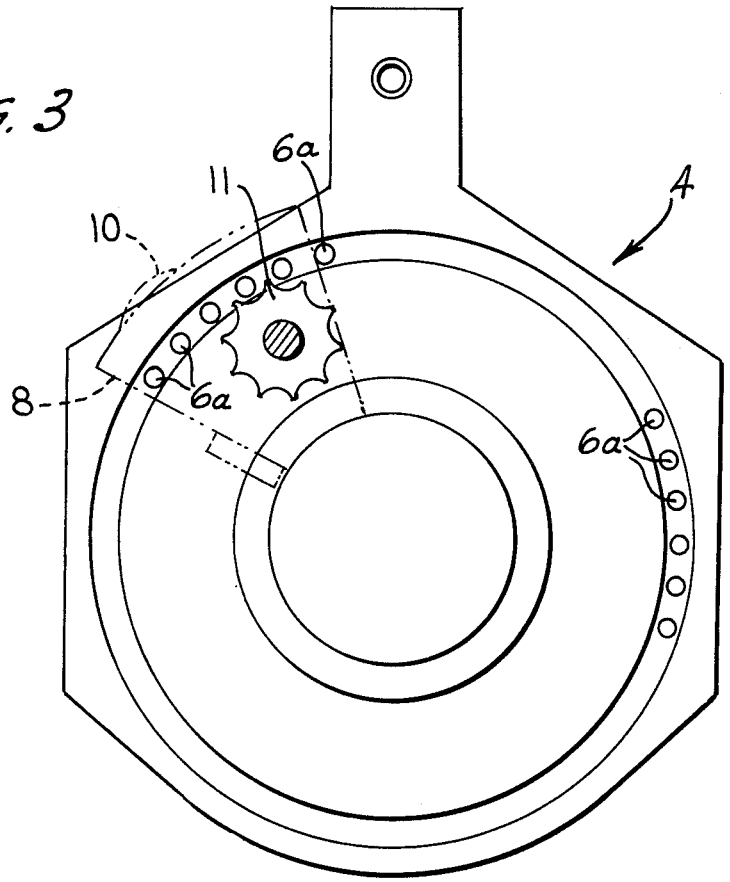
FIG. 3 is a view of the check digit numerator mechanism on the side of a printing cylinder.

The check digit printing mechanism includes an indexing mechanism in the form of a cage which includes a pair of parallel plates 8 (FIG. 2) between which plates are mounted a check digit printing wheel 10. The edge of the printing wheel extends freely beyond the periphery of the plate surfaces 9. The printing wheel 10 has a plurality of printing faces corresponding in number to the weighting which is to be used. In the embodiment described and shown in FIG. 2 the printing wheel has 11 printing faces. A toothed wheel 11 is mounted on one of the side plates 8 and is connected by a one-to-one gear train to the wheel 10 so that the wheels 10, 11 rotate together. The wheel 11 has an equispaced number of teeth the same number of teeth 11 as the number of printing faces on the printing wheel 10. However as shown in the alternative arrangement FIG. 3 this wheel 11 has 10 teeth with 10 faces on the printing wheel 10 and there are six solenoids instead of the seven solenoids previously described. The teeth of the toothed wheel 11 are so arranged that they project between the armatures 6*a* of the solenoids 6 when the armatures are extended in their operative position. As the indexing mechanism rotatably carries the printing wheel and the toothed wheels 11 on the check digit numerator mechanism 4 so the teeth of the gear wheel travel in the circumferential path in which the solenoid armatures 6*a* project so that the teeth come into contact with any armatures of the solenoids whereby the toothed wheel is rotated on the numerator mechanism 4 (see FIG. 3.). Thus, if as shown, (FIG. 2) there are eleven teeth on the toothed wheel 11 and the armatures of five of the solenoids are extended into the path of the toothed wheel, then the toothed wheel will be rotated by five elevenths of the circumference of the printing wheel which means that the toothed wheel will be rotated by approximately 164°.

When the solenoids 6 are deenergized their armatures 6*a* lie retracted within or closely adjacent to the plate 8 and out of the path of the teeth on the toothed wheel, but when the solenoids are energized the armatures extend out of the plate 8 and lie in the circumferential path of the teeth of the toothed wheel 11. Thus when the armatures are retracted and as the numerator mechanism rotates the printing wheel 10 is not rotated on the numerator mechanism. However, when a predetermined number of solenoids 6 are operative a corresponding number of armatures 6*a* are extended to project into the path of the teeth of the toothed wheel 11, whereby the toothed wheel is rotated by an angle equivalent to the number of armatures extended.

The toothed wheel 11 is connected through a one-to-one gearing to the printing wheel 10 so that as the toothed wheel is rotated so the printing wheel is rotated. Moreover, it will be apparent that as the toothed wheel (FIG. 2) is rotated through 164° or the equivalent of five printing faces. The printing wheel is similarly rotated. The printing face wheel is solid with a recessed wheel having equispaced recesses corresponding in number to the number of printing faces and a nose on a spring urged lever engages in one of these recesses so that the printing faces are correctly retained in position. For certain applications it may be preferred to retain a gear toothed wheel 11 having a predetermined number of teeth (say 10) and to accommodate for different loadings by different gear trains.

Figure 4:
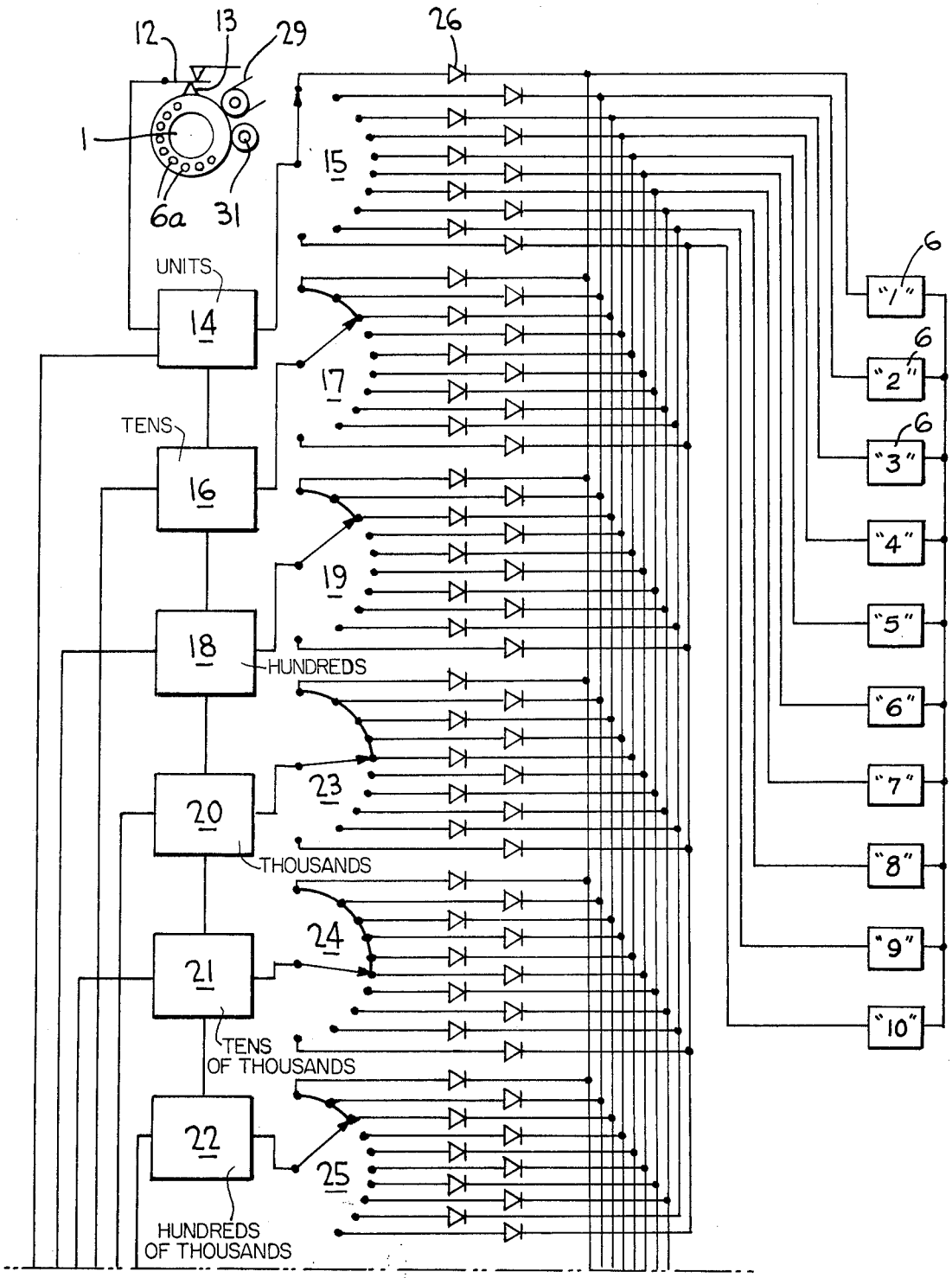
FIG. 4 is a circuit diagram for determination of check digits to control the actuation of solenoids in the check digit mechanism.
Figure 4:
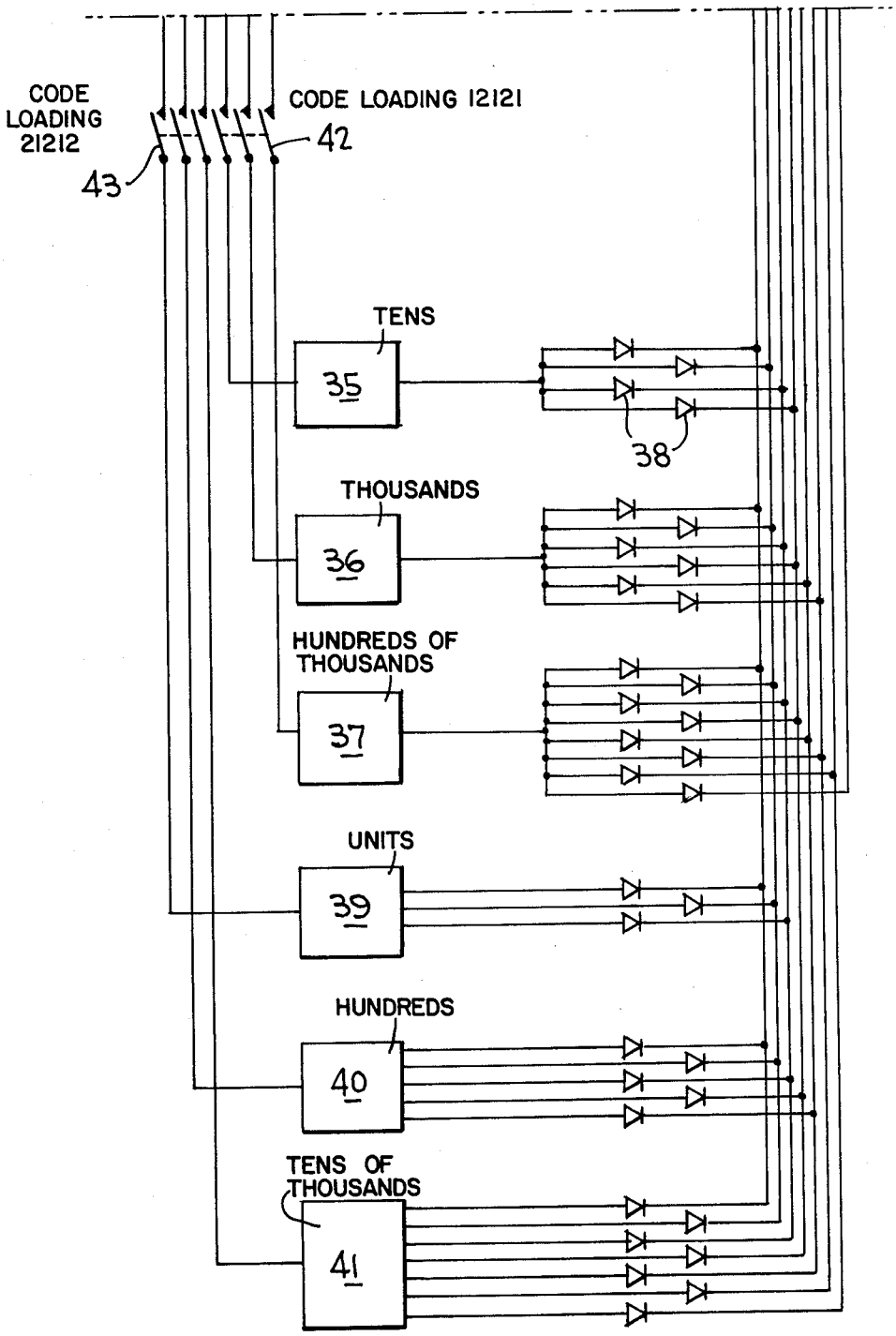

Referring to FIG. 4 there is shown a simplified diagrammatic circuit for enabling a check digit to be determined. The circuit shown includes a switch 12 which can be a contactless proximity switch which is closed by an eccentric on the printing cylinder 1 so that the switch is operated three times for each revolution of the printing cylinder. The switch 12 is connected in circuit with a 'units' counting circuit 14. This counting circuit counts up to a number which corresponds to the modulus number to be employed. Thus, if the modulus 10 is to be employed, the circuit 14 is a "count up to 10" circuit. The circuit 14 is arranged to emit a pulse to a manual selector switch 15 each time the switch 12 is closed unless a carry pulse is emitted as will be hereinafter described. The selector switch 15 has a wiper contact which moves over a series of contacts, for example contacts representative of the number 0 to 9. The counting circuit 14 on receipt of each tenth pulse, emits a carry pulse to be passed to a further modulus number circuit 16 representing tens of units. However, when this occurs no pulse is sent to the selector switch 15. If the modulus 10 is to be employed, this tens of units circuit 16 is also a "count up to 10" circuit which passes on a pulse to a circuit switch 17 each time a pulse is received from the circuit 14 unless a carry pulse is emitted and also emits a carry pulse to a further "count up to 10" circuit each time a tenth pulse is received from the counting circuit 14. Likewise, a hundreds of units counting circuit 18 passes on the pulses received from the counting circuit 16 to a selector switch 19. Similar counting circuits 20, 21 and 22 representing respectively thousands of units, tens of thousands of units and hundreds of thousands units, are also included and each of these counting circuits co-operates with the respective selector switches 23, 24 and 25, each counting circuit 20, 21 and 22 being arranged to pass on a pulse to its associated selector switch 23, 24 and 25 each time a pulse is received from the counting circuit of a lower denomination except when it itself emits a carry pulse and also being arranged to pass on carry pulses to the next higher counting circuit each time a tenth pulse is received by it.

The selector switches 15, 17, 19, 23, 24 and 25 are set up in accordance with the numerical pattern determined by the code loading selected. Thus, for example, if the code loading 12121 is selected the digits selector switch 15 will be set to position 1, the tens selector switch 17 will be set to position 3 and the hundreds selector switch 19 will be set to position 3. Likewise, selector switches 23, 24 and 25 will also be set to the respective positions 5, 5, 3. As shown the selection of appropriate loadings and modulii are achieved by selector switches but it can also be achieved in circuits including printed circuit boards by inserting different circuit boards into the mechanism.

Each stationary contact of each selector switch 17 is connected to a respective rectifier diode 26 with a solenoid 6. The position 1 on the selector switch 15 is connected through a diode with a solenoid 6 representative of the number one. So if a pulse is passed through the contact associated with the position one on the selector switch 15, the pulse is passed through the respective diode 26 to the solenoid 6 corresponding to the "one" condition. Likewise, the second position of the selector switch 15 is connected through a diode to a further solenoid 6 representative of the number "two." Likewise similar connections are made from the positions 3, 4, 5 etc. on the selector switch through respective diode 26 to the respective solenoids 6, representing the numbers 3, 4, 5, etc. The fixed contacts of the selector switch 17 which also represent the numbers 1, 2, 3, etc., are likewise each connected through a respective diode and are likewise connected to solenoids 6 representative of the numbers 1, 2, 3, etc. Furthermore, the selector switches 19, 23, 24 and 25 also have their sets of contacts connected through respective diodes 26 also having respective solenoids 6 representative of the numbers 1, 2, 3, etc.

Each of the solenoids 6 has an armature 6a (FIG. 3) which is in fact located closely adjacent to the printing cylinder 1. As hereinbefore described it is arranged that when the armature 20 of the solenoid 6 is energized, the armature will pass into the path of the number mechanism on the printing cylinder 1 in such a way that the number mechanism will be operated so that the check digit number is increased or decreased by one each time the said numbering mechanism passes over an armature. Thus, for example if a check digit number is to be decreased by one in accordance with the loading code, a single armature will project into the path of the check digit numbering mechanism (which is of known type) and this will serve to move the numbering mechanism in a rearward direction by one digit thereby decreasing the code digit number by one. Likewise, if the check digit number is to be decreased by four, four armatures are arranged in the path of the number mechanism to decrease the number by four. An ink roller 31 (FIG. 4) applies ink to the printing cylinder 1 and to the check digit numerator mechanism 4 and a web of continuous stationery or other paper 29 is passed beneath the printing cylinder 1 to effect the printing of the serial number and beneath the check digit mechanism 4 to print the check digit number.

When it is required to use a check digit numbering system which is modified in that the sum of the digits of the product numbers are used rather than to use the sum of the product numbers additional circuits are employed. In such a modified system for example using the loading 121212 the check number representative of each digit has its own digits added up. Thus when the number 005 is considered with the loading 121212 and the modulus 10 this is calculated:

| | Digits. | |
|---|---|---|
| Number | 5 | |
| Loading | 2 | |
| Total | 10 | Check Digit 1 + 0 = 1 |

instead of the straightforward calculation:

| | Digits. | |
|---|---|---|
| Number | 5 | |
| Loading | 2 | |
| | 10 | Total = 10<br>Check Digit = 0 |

Or if one considers the check digit of the number 6789 using the loading 12121 and the modulus 10 this is calculated as follows:

| | Digits | Tens | Hundreds | Thousands |
|---|---|---|---|---|
| Number | 9 | 8 | 7 | 6 |
| Loading | 1 | 2 | 1 | 2 |
| | 9 | 16 | 7 | 12 = 26. |

-continued

| | Digits | Tens | Hundreds | Thousands |
|---|---|---|---|---|
| Total | 9 + 1 + 6 + 7 + 1 + 2 | | | = 26. |

The check digit can then be 6 (the remainder when the modulus or a multiple of the modulus is deducted from the total) or 4 (the complement of the remainder).

It has been found that if a schedule of such check digits used with a 12121 loading and a 10 modulus is considered, it is found that the check digit number increases by 4 each time 50 numbers are printed, by 6 each time 5000 numbers are printed and by 8 each time 500000 numbers are printed.

Similarly when the loading 121212 and the modulus 10 is used it is found that the check digit increase by three each time 5 numbers are printed by five each time 500 numbers are printed and by 7 each time 50000 numbers are printed.

For use with a mechanism for printing a digit product number check digit using the modified check digit system the modulus 10 and the loading 12121, and additional connection is made from the fifth position in the circuit 16 (representing tens of units) to an additional circuit 35 and this circuit 35 is connected to four diodes 38 in parallel. The first diode is connected to the first solenoid 6 and the second diode is connected to the second solenoid 6 etc. Thus, the fifth position in the circuit 16 representing 50 is connected to the additional circuit 35 and thence to the first four solenoids of the solenoids 19. Similarly, connections are made from the fifth position of the circuit 20 (representing 5000) to the second additional circuit 36 which in turn is connected through diodes 16 to the first six solenoids of the solenoids 6. Furthermore, connections are made from the fifth position of the circuit 22 (representing 500,000) to a circuit 37 which in turn is connected through diodes to the first three solenoids of the solenoids 6. Similarly for using the modified check digit system with a modulus 10 and a loading 1212 additional connections are made from the fifth position of the circuits 14, 15 and 21 to respective additional circuits 39, 40, 41 corresponding to the circuits 35, 36, 37.

The circuits 39, 40, 41 are connected in turn to diode circuits having three, five and seven diodes respectively and thence to the sets of solenoids 6 in parallel with the connections from the circuits 35, 36, 37. By these circuits additional pulses are supplied to control the setting of the solenoids 6.

If the coding 12121 is used the switches 42 in the leads from the circuits 14, 20, 22 to the additional circuits are closed whereas if the coding 21212 is used the switches 43 in the leads from the circuits 14, 18, 21 to the circuits 39, 40, 41 are closed to render the respective additional circuits operative.

For certain applications where there is no necessity for zero changes to the check digit the first one of the solenoid etc mechanisms including the armature may be replaced by a fixed pin. The fixed pin thereby constitutes a static armature.

Furthermore if for such applications there is no necessity for zero or single movement changes the first and second of the solenoid mechanisms including the moving armatures, may be replaced by two respective fixed pins. These fixed pins are permanently in the path of the toothed wheel 11 so that it will be moved around by the single or double distance movements at each printing cycle.

When a check digit number machine is in operation and assuming that the printing starts from the number 000, the check digit number will be 0. If the modulus 10 is employed, each of the counting circuits 14, 16, 18, 20, 22 will comprise a "count up to 10" circuit and if the loading code 12121 is to be used, the selector switch representing the digits will be set to position one, selector 17 representing tens will be set to the position three and selector switch 3 representing hundreds will be set to position three. As printing progresses each time the printing cylinder effects one third of a revolution, the switch 12 is closed to make a circuit to the counting circuit 14. Each time this happens the counting circuit 14 passes a pulse to the selector switch 15 and this pulse is passed through the diode 16 to the solenoid 6 presenting the numeral one and this causes a single armature to be energised and moved into the path of the numbering mechanism of the printing cylinder 1. Thus, the numbering mechanism is decreased by a single digit just prior to each of the numbers 0 to 9 being printed. When the number 10 is reached, a pulse is passed to the counting mechanism 14 and a single pulse is passed to the selector switch 15 which serves to move the armature associated with position one into the path of the movement of the numbering mechanism of the printing cylinder 1 to advance this by one position. At the same time a pulse is passed to the counting circuit 16 and this causes a pulse to be passed to the selector switch 17 which is in position three. This causes the pulse to pass to the first three solenoids 6. Thus two armatures 20 are moved into the path of the numbering mechanism to decrease the position of this numbering mechanism by three digits. Likewise, when the number 100 is reached a pulse is passed from the "counting up to 10" circuit 16 to the "count up to 10" circuit 18 and this causes a pulse to be passed through position three on the selector switch 19 to cause solenoids 6 representative of the number three to be energised and this causes the check digit number being printed to be decreased by three. When an armature and its associated solenoid is replaced by a fixed pin the supply of pulses to the solenoid will not occur but be open circuited.

If it is required to print a digit product number check the circuits 35, 36 and 37 or 39, 40, 41 are brought into use so that for example using the loading 12121 three of the solenoids 6 are energised each time 50 numbers are printed to decrease the check digit number by four. Six of the solenoids are energised each time 5000 numbers are printed to decrease the check digit number by six and three of the solenoids are energised each time 500,000 numbers are printed to decrease the check digit number by three.

By this means a check digit number may be printed on cheques or other documents as they are printed and if any incorrect check digit number is printed this fault is perpetuated and the fault can be easily detected.

It will be apparent that by alteration of the positions of the switches 15, 17, 19, 23, 24, 25, the weighting of the code may be altered in a simple and convenient manner, and by changing the number up to which the counting circuits 14, 16, 18, 20, 21, 22 count, and the number of printing faces on the check digit numerator 4 and the number of teeth on the toothed wheel 11 the modulus loading may be easily altered.

What is claimed is:

1. Check digit numbering mechanism for generating check digits in accordance with a check digit load setting, comprising:

printing means for seriatim printing of reference numbers on a printing medium;

check digit printing means for printing a check digit on said printing medium for at least some of said reference numbers;

means for generating a signal each time a reference number is printed;

check digit numerator means for indexing said means for printing a check digit;

a plurality of solenoids and a corresponding plurality of armatures each associated with a particular one of said solenoids, said solenoids and said check digit numerator means being movable with respect to one another, at least one of said armatures being movable to engage said check digit numerator means for the actuation thereof with the relative motion of said check digit numerator means and said solenoids;

control means responsive to each of said signals for selectively actuating said plurality of solenoids to index said check digit numerator means whereby a check digit associated with said reference number is printed on said printing medium; and said control means including switching means for changing the setting of said control means to select those solenoids to receive said signals in accordance with said check digit loading setting.

2. Check digit numbering mechanism according to claim 1 wherein at least one of said armatures is statically positioned to engage said check numerator means.

3. Check digit numbering mechanism according to claim 1 wherein said digit numerator means is rotatable and said check digit printing means is mounted thereon and includes printing wheels having a plurality of printing faces each bearing a different check digit number and said check digit numerator means includes a rotatable toothed wheel engaging said printing wheel, said plurality of solenoids are stationary, and said toothed wheel is rotated to position a respective printing face whereby a check digit number is printed on said printing medium in accordance with the number of actuated solenoid armatures.

4. Check digit numbering mechanism as in claim 1 wherein said printing means is rotatable and said means for generating a signal includes second switching means having a movable contact and a fixed contact and an eccentric means mounted on said means for printing reference numbers for actuating said movable contact with rotation of said means for printing reference numbers.

5. Check digit numbering mechanism according to claim 1 wherein said control means is set to a predetermined check digit modulus and said switching means includes a plurality of serially connected counters and a plurality of selector switch means, each selector switch means being connected to a respective counter and including a plurality of switching positions each respectively connected to a respective solenoid, said counters being interconnected by means for conducting a carry pulse and the first of said counters being responsive to each of said signals, each of said selector switch means being settable to provide a predetermined check digit loading setting.

6. A check digit numbering mechanism as in claim 5 wherein said predetermined modulus is ten and each of said plurality of counters counts to ten to provide a carry pulse to the next successive counting circuit on reception of the tenth signal input.

7. A check digit numbering mechanism as in claim 5 wherein said control means further includes additional counters and third switching means interconnecting selected ones of said counters and said additional counters, the selected actuation of said third switching means altering the check digit loading setting of said control means; and means respectively interconnecting said additional counters and preselected solenoids of said plurality of solenoids.

8. A check digit numbering mechanism as in claim 7 wherein said means for interconnecting comprises groups of diodes, each group of diodes being associated with each of said additional counters and each diode in each group having one terminal connected to an output of its associated additional counter and the other terminal respectively connected to a respective one of said plurality of solenoids.

9. A check digit numbering mechanism as in claim 8 wherein said third switching means are set to provide a check digit loading setting of 21212.

10. A check digit numbering mechanism as in claim 8 wherein said third switching means are set to provide a check digit loading setting of 12121.

* * * * *